United States Patent [19]

Kurokawa et al.

[11] Patent Number: 4,754,703

[45] Date of Patent: Jul. 5, 1988

[54] METHOD OF ELECTRICALLY BLASTING DETONATOR AND CORDLESS DETONATOR FOR USE IN SAID METHOD

[75] Inventors: Koichi Kurokawa; Takeo Ueda, both of Aichi, Japan

[73] Assignee: Nippon Oil and Fats Co. Ltd., Tokyo, Japan

[21] Appl. No.: 17,694

[22] Filed: Feb. 24, 1987

[30] Foreign Application Priority Data

Feb. 27, 1986 [JP] Japan ..... 61-40227

[51] Int. Cl.[4] ..... F42B 3/18

[52] U.S. Cl. ..... 102/202.5; 102/200; 102/202.2

[58] Field of Search ..... 102/200, 202.1, 202.2, 102/202.5

[56] References Cited

U.S. PATENT DOCUMENTS 4,273,051 6/1981 Stratton ..... 102/202.2

4,425,849 1/1984 Jorgenson ..... 102/200

4,519,314 5/1985 Jorgenson ..... 102/202.2

4,601,243 7/1986 Ueda et al. ..... 102/200

*Primary Examiner*—Charles T. Jordan

*Attorney, Agent, or Firm*—Parkhurst & Oliff

[57] ABSTRACT

A loop portion of a bus wire connected to an electric blasting device is passed through a first magnetic core together with a first loop-like wire, and the first loop-like wire is further passed through a second magnetic core provided in a detonator. The detonator includes a second loop-like wire which is passed through the second magnetic core, an electric bridge connected to the second loop-like wire and a fuse head provided around the electric bridge. When a pulsatory high frequency current is supplied to the bus wire, high frequency currents are induced in the first and second loop-like wires by electromagnetic induction. Then the current flows through the electric bridge of the detonator to fire the primer explosive.

8 Claims, 5 Drawing Sheets

METHOD OF ELECTRICALLY BLASTING DETONATOR AND CORDLESS DETONATOR FOR USE IN SAID METHOD

BACKGROUND OF THE INVENTION

1. Field of the Invention and Related Art Statements

The present invention relates to a method of electrically blasting one or more detonators electromagnetically coupled with a bus wire via one or more magnetic cores by supplying a high frequency electric current to the bus wire. The invention also relates to an electric cordless detonator for use in said electrical blasting method.

In a Japanese Patent Application Laid-open Publication No. 86400/85 (corresponding to U.S. Pat. No. 4,601,243 issued on July 22, 1986), there is disclosed the method of electrically blasting a plurality of detonators which are electromagnetically coupled with a bus wire with the aid of transformer magnetic cores by supplying a pulsatory high frequency current to the bus wire. FIG. 1 is a schematic view illustrating this known method. To an electric blasting device 1 comprising an electric power source and an oscillator for generating the high frequency current, is connected a bus wire 2 having a loop portion 2A with which a transformer magnetic core 3 is electromagnetically coupled. With the magnetic core 3 is further electromagnetically coupled a loop-like wire 5 electrically connected to a fuse head of a detonator 4. When the pulsatory high frequency current is supplied from the electric blasting device 1 to the bus wire 2, a high frequency current is induced in the loop-like wire 5 via the magnetic core 3 by means of the electromagnetic induction. Then, the fuse head in the detonator 4 is heated to fire and a detonating explosive is exploded.

In such a method, a pair of leg wires of the detonator are connected in the form of the loop wire 5, and thus leg wires are considered to be always short-circuited from the operation of coupling the loop wire 5 with the bus wire 2 via the magnetic core 3 to the actual exploding operation and the electric energy is hardly introduced into the loop wire. Therefore, any undesired explosion of the detonator can be effectively prevented.

In the above explained known method, the detonator is the same as an ordinary detonator except for a point that the leg wires are short-circuited into the loop. Therefore, if the loop wire were to be cut or an insulating sheath of the wire were to be broken, the electric energy could be introduced into the wire and the detonator might be accidentally exploded.

In such an occasion, the known blasting method could remove undesired explosion only to such an extent that ordinary blasting methods can attain.

SUMMARY OF THE INVENTION

The present invention has for its object to provide a novel and useful method of electrically blasting one or more detonators, in which the detonators can be exploded only by the electric energy which is supplied from the electric blasting device via the bus wire and one or more magnetic cores, so that the detonators could not be exploded accidentally by means of any undesired electric energy introduced into the detonators.

It is another object of the invention to provide a cordless detonator which can be used in the electrical blasting method according to the invention.

According to the invention, a method of electrically blasting at least one detonator by supplying a high frequency current to a bus wire having at least one loop portion, comprises the steps of:

- coupling electromagnetically at least one first magnetic core with a loop portion of a bus wire;
- coupling electromagnetically the first magnetic core with at least one first loop-like wire;
- coupling electromagnetically the first loop-like wire with at least one second magnetic core which is provided in a detonator and is coupled electromagnetically with a second loop-like wire which is connected to an electric bridge for firing a fuse head; and
- supplying a high frequency current to the bus wire to induce high frequency currents in the first and second loop-like wires, whereby the high frequency current induced in the second loop-like wire is supplied to the electric bridge of the detonator to fire the fuse head and to blast the detonator.

Further according to the invention a cordless detonator for use in a method of electrically blasting a detonator by means of electromagnetic induction comprises

- a tubular body having an opening at one end;
- a primer explosive provided in said tubular body;
- a fuse head arranged in said tubular body for exploding said primer explosive;
- an electric bridge arranged in said tubular body for firing said fuse head;
- a loop-like wire electrically connected to said electric bridge and extending outside said tubular body;
- a magnetic core having a central passage through which said loop-like wire is passed; and
- means for coupling said tubular body and magnetic core with each other to form an integral body.

DESCRIPTION OF THE PREFERRED EMBODIMENTS

Figure 1:
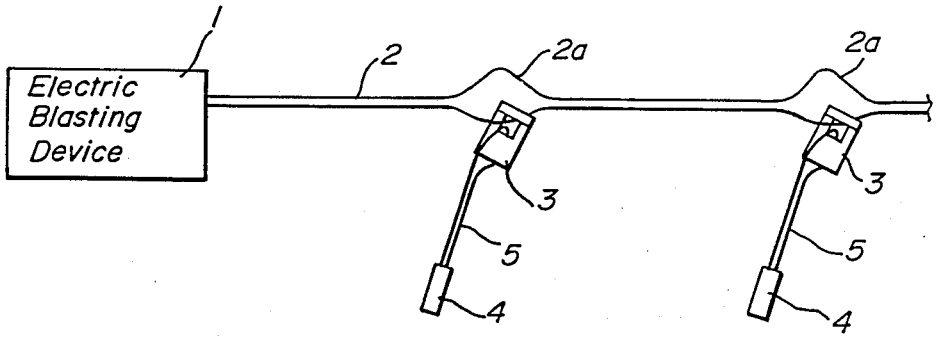
FIG 1 (PRIOR ART)
FIG. 1 is a schematic view showing the known method of electrically blasting a plurality of detonators by means of electromagnetic induction.
Figure 2:
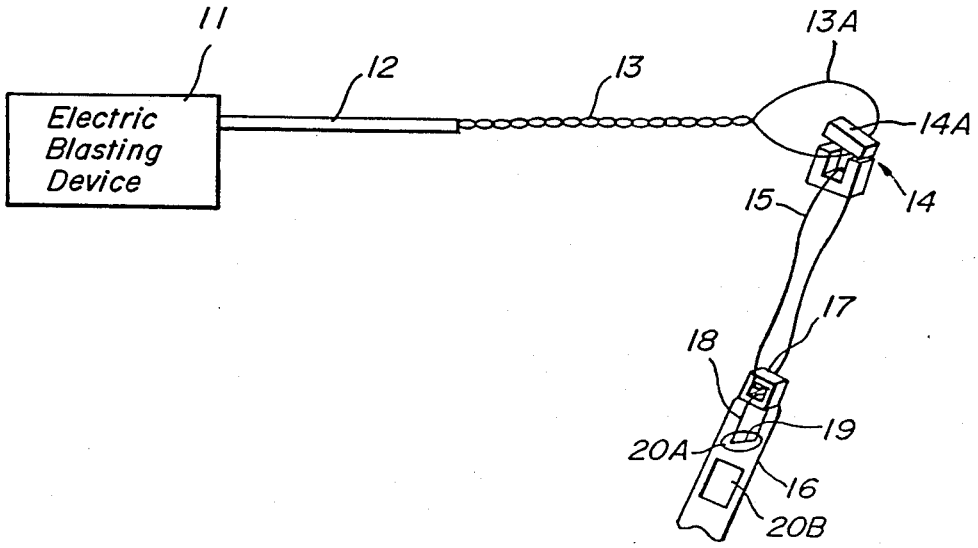
FIG. 2 is a schematic view illustrating an embodiment of the electrical blasting method according to the invention.

FIG. 2 is a schematic view illustrating an embodiment of the electrical blasting method according to the invention. An electric blasting device 11 generates a pulsatory high frequency signal to a bus wire 12 to which is connected an auxiliary bus wire 13. The auxiliary bus wire 13 has a loop portion 13A with which a first transformer magnetic core 14 is electromagnetically coupled. With the first magnetic core 14 is also electromagnetically coupled a first loop-like wire 15. In order to facilitate the operation for coupling the loop portion 13A and first loop like wire 15 with the first magnetic core 14, the first magnetic core is formed into a square ring and one side block 14A is movable with respect to the remaining block so as to form a space therebetween. After the wires are passed through the space of the first magnetic core 14, the side block 14A is moved to close said space. In the present embodiment, the first magnetic core 14 is made of ferrite and has a thickness of about 10 mm and one side length of about 15 mm.

According to the present invention, the first loop-like wire 15 is electromagnetically coupled with a second transformer magnetic core 17 which is provided integrally with an electric detonator 16. With the second magnetic core 17 is further electromagnetically coupled a second loop-like wire 18 which is connected to an electric bridge 19 around which a fuse head 20A is provided. In the detonator 16 there is further provided a primer explosive 20B. If necessary, there may be further arranged an additional explosive in the detonator 16.

When a blasting switch provided on the electric blasting device 11 is actuated, the pulsatory high frequency current of 30 kHz to 1 MHz is supplied to the bus wire 12 and auxiliary bus wire 13, and a pulsatory high frequency current having the same frequency as that generated from the blasting device 11 is induced in the first loop-like wire 15 by means of electromagnetic induction. Then, in the second loop-like wire 18 is also induced a high frequency current of the same frequency via the second magnetic core 17. This current flows through the electric bridge 19 of the detonator 16 and the fuse head 20A is heated and fired. Then, the primer explosive 20B is exploded. In this manner, the detonator 16 can be exploded by electromagnetic induction.

As explained above, in the method according to the invention, any undesired electric energy could never be introduced into the electric bridge 19 of the detonator 16, because the second loop-like wire 18 connected to the electric bridge 19 is not exposed outside, but is embedded within the detonator 16. Therefore, any unexpected or erroneous explosion of the detonator can be prevented positively. Further, the first loop-like wire 15 can be easily coupled with the detonator 16 only by passing the wire 16 through a central passage of the second magnetic core 17 integrally provided in the detonator 16. That is to say, after the wire is passed through the second magnetic core 17, both ends of the wire are connected with each other to form the loop.

Usually, a plurality of detonators are exploded during one blasting operation. In an embodiment shown in FIG. 3A, a single first magnetic core 14 is coupled with a loop portion 13A of an auxiliary bus wire 13 connected to an electric blasting device 11 through a main bus wire 12, and a plurality of second loop-like wires 15-1, 15-2, . . . 15-N are coupled with the first magnetic core 14. Each second loop-like wire is then electromagnetically coupled with respective detonators 16-1, 16-2, . . . 16-N. In an embodiment depicted in FIG. 3B, an auxiliary bus wire 13 has a plurality of loop portions 13A-1, 13A-2, . . . 13A-K each of which is electromagnetically coupled with a respective one of first magnetic cores 14-1, 14-2, . . . 14-K. With each of the first magnetic cores 14-1, 14-2, . . . 14-K is electromagnetically coupled a plurality of second loop-like wires 15-1-1, 15-1-2, . . .; 15-2-1, 5-2-2, . . .; . . .; 15-K-1, 15-K-2, . . . 15-K-N. Finally each second loop-like wire is electromagnetically coupled with respective detonators 16-1-1, 16-1-2, . . .; 16-2-1, 16-2-2 . . .; . . .; 16-K-1, 16-K-2 . . . 16-K-N.

Figure 3A:
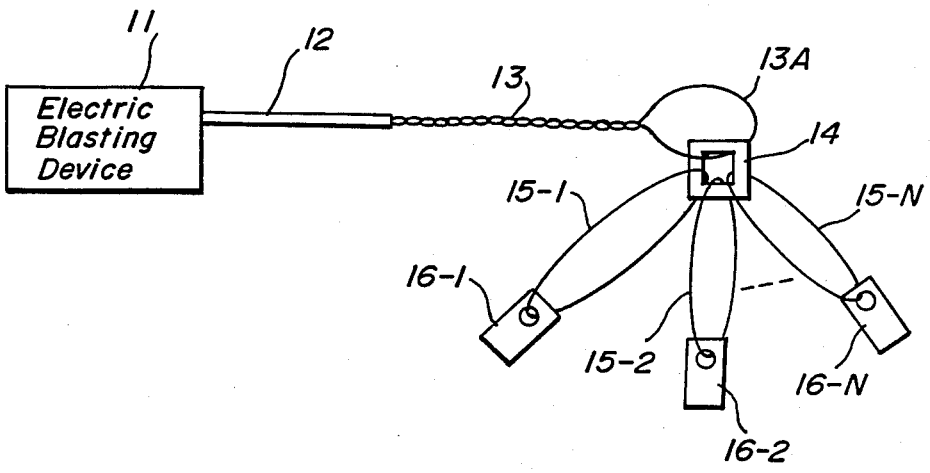
FIGS. 3A and 3B are schematic views depicting other embodiments of the method according to the invention for electrically blasting a plurality of detonators.
Figure 3B:
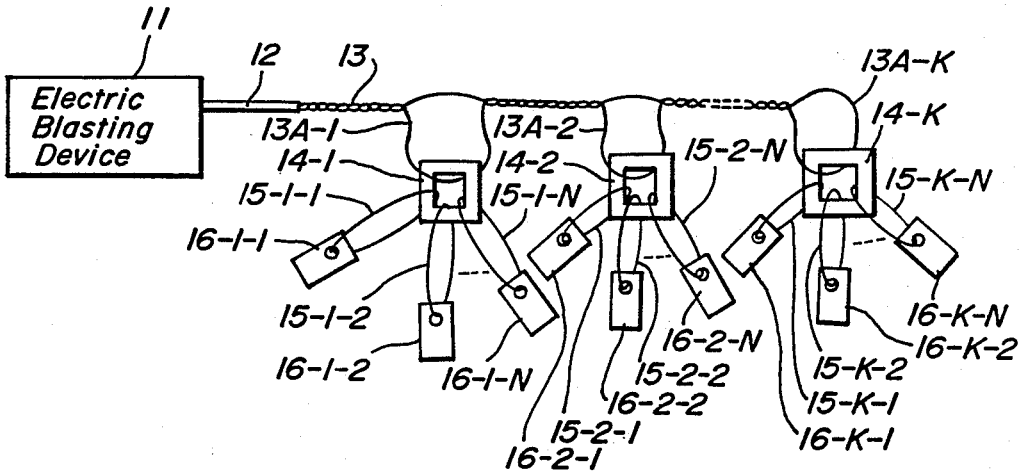

In order to explode a plurality of detonators it is also possible to couple a first magnetic core with a loop portion of an auxiliary bus wire. Then one or more auxiliary loop-like wires are electromagnetically coupled with the first magnetic core, each auxiliary loop-like wire is coupled with respective auxiliary transformer magnetic cores, and one or more first loop-like wires are coupled with each of the auxiliary magnetic cores. Finally, each first loop-like wire is electromagnetically coupled with respective detonators. In such a fan-out construction, there is provided an additional electromagnetic coupling between the first magnetic core and first loop-like wire, and the amplitude of a high frequency current induced in the second loop-like wire provided in the detonator is liable to be small. Therefore, the methods shown in FIGS. 3A and 3B are preferable. In these methods, it is also possible to couple the first loop-like wire with a plurality of detonators.

Figure 4A:
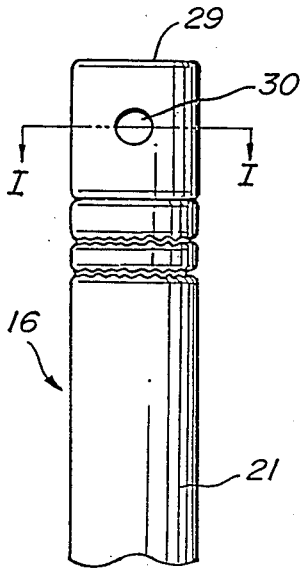
FIGS. 4A, 4B and 4C are front and cross sectional views, respectively showing an embodiment of the cordless detonator according to the invention.
Figure 4C:
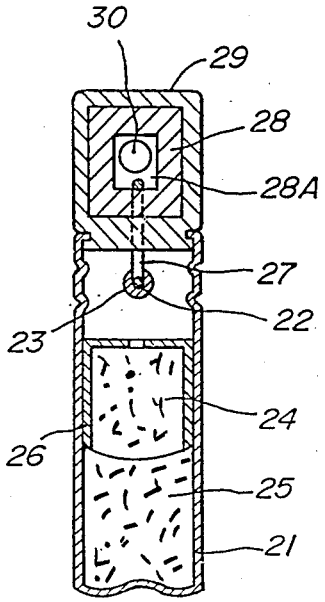
Figure 4B:
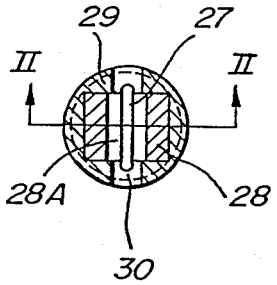

FIGS. 4A to 4C show an embodiment of the electric detonator according to the invention. FIG. 4A is a front view, FIG. 4B is a transversal cross section cut along a line I—I in FIG. 4A and FIG. 4C is a longitudinal cross section cut along a line II—II in FIG. 4B. The electric detonator 16 comprises a tubular body 21 made of a metal having an opening at one end. In the tubular body 21 are inserted an electric bridge 22 made of a platinum wire, a fuse head 23 applied around the bridge, primer explosive 24 and additional explosive 25 in this order viewed from the opening. The primer explosive 24 and additional explosive 25 are accommodated in an inner tube 26. The construction of the detonator 16 so far explained is the same as that of ordinary detonators. According to the invention, a loop-like wire 27 connected to the electric bridge 22 is extended outside the tubular body 21 through its opening, and then is passed through a magnetic core 28 serving as the above explained second transformer magnetic core. In this embodiment, the magnetic core 28 is embedded in a plug made of elastic material such as rubber. In the plug 29 is formed a hole 30 which is communicated with a central passage 28A of the magnetic core 28. Through the hole 30 of the plug 29 the first loop-like wire (for instance, the loop-wire 15 shown in FIG. 2) can be passed through the magnetic core 28. As clearly shown in FIG. 4C, the loop-like wire 27 of the detonator is extended downward beyond the plug 29 and is connected to the electric bridge 22. The plug 29 having the transformer magnetic core 28, loop-like wire 27, electric bridge 22 and fuse head 23 composed integrally therewith is inserted into the opening of the tubular body 21. Then the upper edge of the tubular body 21 is caulked to couple the tubular body with the plug 29 firmly. In the present embodiment, since the magnetic core 28 is embedded in the rubber plug 29, the magnetic core can be effectively protected against shock, and the operation for assembling the magnetic core 28 and tubular body 21 integrally with each other can be made very easy. In this case, it is preferable to embed the magnetic core 28 wholly in the plug 29, but the magnetic core may be partially exposed out of the plug.

Figure 5A:
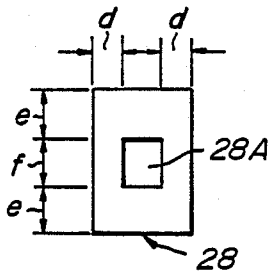
FIGS. 5A, 5B and 5C and FIGS. 6A, 6B and 6C are front, plan and side views, respectively showing two embodiments of the magnetic core provided in the cordless detonator according to the invention.
Figure 5C:
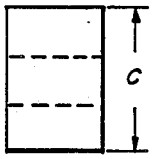
Figure 5B:
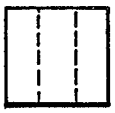

FIGS. 5A, 5B and 5C are front, plan and side views, respectively, showing an embodiment of the magnetic core 28 accommodated in the cordless detonator according to the invention. In the present embodiment, the magnetic core 28 has generally a rectangular shape and has also a rectangular central passage 28A. If use is made of a large magnetic core, it is possible to obtain a large magnetomotive force. However, if use is made of existing tubular bodies for use in ordinary detonators, the dimensions of the magnetic core are naturally limited. That is to say, dimensions d, e and f of the magnetic core shown in FIG. 5A are restricted. However, a height c of the magnetic core is not limited as long as a condition, $e \geqq d$ is satisfied, because a length f of the central passage 28A of the magnetic core 28 is concerned. That is to say, the smaller the central hole 28A is, the shorter an average magnetic path length becomes and a large magnetomotive force can be obtained. However, in order to pass the first and second loop-like wires easily, the central passage 28A must have a certain dimension. The height c of the magnetic core 28 should be determined such that the above requirement is satisfied.

Figure 6A:
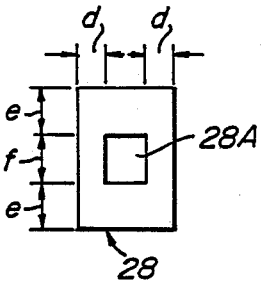
Figure 6C:
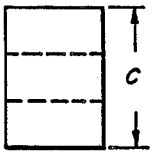
Figure 6B:
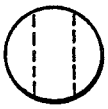

FIGS. 6A, 6B and 6C illustrate another embodiment of the magnetic core provided in the cordless detonator according to the invention. In the present embodiment, the magnetic core 28 has a right cylindrical shape and a rectangular central passage 28A is formed in a radial direction.

As explained above, according to a invention the magnetic core having various shapes may be provided in the cordless detonator. Further, the central passage of the magnetic core may have any desired shape as long as a large magnetomotive force is obtainable and the wire can be passed easily through the central passage.

Figure 7:
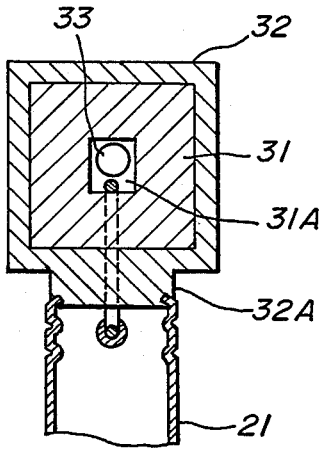
FIG. 7 is a cross sectional view illustrating another embodiment of the cordless detonator according to the invention.

In the above embodiment, the width of the magnetic core is limited by a diameter of the tubular body 21, but in an embodiment illustrated in FIG. 7, a magnetic core 31 having a width larger than the diameter of the tubular body 21 can be used to obtain a large magnetomotive force. In this embodiment, a plug 32 has a thin neck portion 32A at its lower end and the thin neck portion is clamped into the tubular body 21. In this manner, it is possible to embed the large magnetic core 31 in the plug 32, so that a large magnetomotive force can be attained and a central passage 31A of the magnetic core 31 and a center hole 33 of the plug 32 can be made large, so that the wires can be easily passed through them.

Now some experimental examples of the electrically blasting method according to the invention will be explained. In these experiments, as the electric blasting device use was made of NISSAN BLASTER-LB-4W (trade name: manufactured and sold by Nippon Oil and Fats Co., Ltd.) which generates a pulsatory current having a high frequency of 100 KHz. To the electric blasting device was connected a bus wire of 100 meters and then an auxiliary bus wire of 25 m having one or more loop portions was connected to the bus wire. One or more first magnetic cores each having a square shape of 15 mm×15 mm and a thickness of 10 mm were coupled with one or more loop portions of the auxiliary bus wire. Next, one or more first loop-like wires each made of a copper conductor having a diameter of 0.4 mm and an insulating coating made of vinyl were passed through one or more first magnetic cores. Each first loop-like wires was further passed through respective second magnetic cores provided in detonators. There were prepared four kinds of the cordless detonators A to D mentioned below.

Type A

The detonator of type A has the construction shown in FIG. 4 and comprises the square magnetic core illustrated in FIG. 5 and having the following parameters:
c=6 mm, d=1.5 mm, e=2 mm, f=2 mm.

Type B

The detonator of type B is constructed as depicted in FIG. 4 and includes the cylindrical magnetic core shown in FIG. 6 and having the following parameters:
outer diameter=5 mm,
d=1.5 mm, e=2 mm, f=2 mm.

Type C

The whole construction of the detonator of type C is shown in FIG. 7 and the cubic magnetic core of 12 mm×12 mm×12 mm has a rectangular central passage of 4 mm×4 mm.

Type D

The detonator of type D has the construction illustrated in FIG. 7 and the cylindrical magnetic core has a diameter of 12 mm and a cylindrical central passage of a diameter of 4 mm.

The detonators were exploded in a manner shown in the following table by supplying the pulsatory high frequency current of 100 KHz to the bus wire.

TABLE

| No. | Type of detonator | Number of first cores | Number of detonators per core | Total number of detonators | Condition of explosion |
|---|---|---|---|---|---|
| 1 | A | 1 | 1 | 1 | exploded |
| 2 | A | 1 | 5 | 5 | all exploded |
| 3 | A | 2 | 5 | 10 | all exploded |
| 4 | A | 10 | 4 | 40 | all exploded |
| 5 | A | 20 | 3 | 60 | all exploded |
| 6 | A | 50 | 2 | 100 | all exploded |
| 7 | B | 10 | 5 | 50 | all exploded |
| 8 | C | 20 | 5 | 100 | all exploded |
| 9 | D | 20 | 5 | 100 | all exploded |

The present invention is not limited to the embodiments so far explained, but many modifications and alternations may be conceived by those skilled in the art within the scope of the invention. In the above embodiments, the loop portion is formed in the auxiliary bus wire, but it may be formed in the main bus wire. In the embodiments shown in FIGS. 4 and 7, the second magnetic core is connected to the tubular body of the detonator by means of the plug, but it is not always necessary to use the plug. Further the magnetic core and its central passage may be formed in various shapes other than rectangular and circular.

As explained above according to the invention, the electric energy is transferred from the electric blasting device to the electric bridge of the detonator via the two steps of electromagnetic induction, i.e. the first electromagnetic coupling between the loop portion of the bus wire and the first loop-like wire by means of the first magnetic core and the second electromagnetic coupling between the first loop-like wire and the second loop-like wire by means of the second magnetic core. Therefore, any unexpected explosion of the detonator can be effectively prevented and the explosion can be carried out very safely. That is to say, even if undesired electric energy is introduced into the bus wire or loop-like wire, the energy is hardly transferred to the detonator. Further, the detonator according to the invention has no leg wires extending from the detonator main body. Rather, the second loop-like wire is provided within the detonator, and any undesired electric energy could not be introduced into the second loop-like wire, so that the safety can be further enhanced. Moreover, since the first loop-like wire for coupling electromagnetically the first and second magnetic cores with each other is completely separated from the detonator, it is not necessary to manage or sort detonators of various types in accordance with lengths and colors of leg wires.

What is claimed is:

1. A cordless detonator for use in a method of electrically blasting a detonator by means of electromagnetic induction comprising a tubular body having an opening at one end;

a primer explosive provided in said tubular body;

a fuse head arranged in said tubular body for exploding said primer explosive;

an electric bridge arranged in said tubular body for firing said fuse head;

a loop-like wire electrically connected to said electric bridge and extending outside said tubular body;

a magnetic core having a central passage through which said loop-like wire is passed; and means for coupling said tubular body and magnetic core with each other to form an integral body, wherein said coupling means is formed by a plug like member which is clamped into the opening of the tubular body and has a hole, and said magnetic core is embedded in the plug like member such that the central passage of the magnetic core is aligned with said hole of the plug like member.

2. A cordless detonator according to claim 1, wherein said plug like member is made of elastic rubber.

3. A cordless detonator according to claim 2, wherein a periphery of the opening of said tubular body is caulked into an outer surface of said plug like member.

4. A cordless detonator according to claim 1, wherein said magnetic core is formed as a rectangular shape.

5. A cordless detonator according to claim 1, wherein said magnetic core is formed as a cylindrical shape.

6. A cordless detonator according to claim 1, wherein said magnetic core is formed as a cubic shape.

7. A cordless detonator according to claim 1, wherein said magnetic core has a width larger than a diameter of the tubular body and said plug like member has a thin neck portion which is clamped into the opening of the tubular body.

8. A cordless detonator according to claim 1, wherein said magnetic core is made of ferrite.

* * * * *